US005806123A

United States Patent [19]

Tono

[11] Patent Number: 5,806,123

[45] Date of Patent: Sep. 15, 1998

[54] VARIABLE ELASTICITY COLLECTION PAN FOR FLOOR CLEANING MACHINES

[76] Inventor: Gianni Tono, 11, via Locchi, Padua, Italy, 35124

[21] Appl. No.: 535,821

[22] Filed: Sep. 28, 1995

[30] Foreign Application Priority Data

Oct. 5, 1994 [IT] Italy ..... PD940104 U
Feb. 10, 1995 [IT] Italy ..... PD95A0035

[51] Int. Cl.[6] ..... E01H 1/04

[52] U.S. Cl. ..... 15/49.1; 15/52.1; 15/83

[58] Field of Search ..... 15/41.1, 49.1, 15/52.1, 78, 82, 83, 84, 85, 86

[56] References Cited

U.S. PATENT DOCUMENTS

| | | | |
|---|---|---|---|
| 435,144 | 8/1890 | Batt | 15/84 |
| 740,218 | 9/1903 | Beatty | 15/84 |
| 1,053,233 | 2/1913 | Shira | 15/84 |
| 1,189,016 | 6/1916 | Thompson | 15/83 |
| 1,256,561 | 2/1918 | Hoffer et al. | 15/83 |
| 1,580,600 | 4/1926 | Holbrook | 15/83 |
| 2,046,679 | 7/1936 | Furstnow | 15/83 |
| 2,275,356 | 3/1942 | Funk | 15/52.1 |
| 2,283,229 | 5/1942 | Richards | 15/83 |
| 3,093,853 | 6/1963 | Tamny | 15/83 |
| 4,709,436 | 12/1987 | Berfield et al. | 15/41.11 |

*Primary Examiner*—Randall E. Chin
*Attorney, Agent, or Firm*—Dowell & Dowell, P.C.

[57] ABSTRACT

A debris collection pan for cleaning machines which is in such a shape and/or constructed of materials such that, as the leading edge thereof slides on a floor and encounters an obstacle, the pan bends upwardly so that the edge in contact with the floor returns to its original position. In one embodiment, the pan for floor cleaning machines has a generally triangular shape, with two sides consisting of arcs which join at an elastic point.

8 Claims, 2 Drawing Sheets

FIG. 3
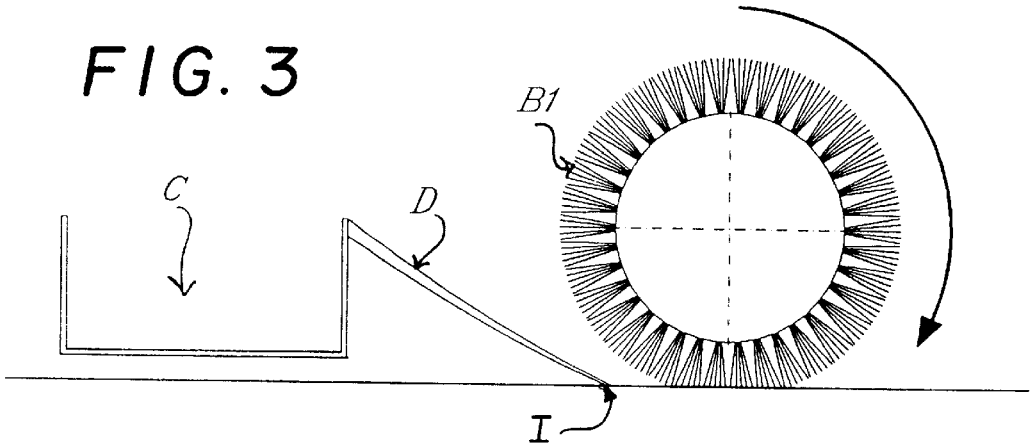
FIG. 4
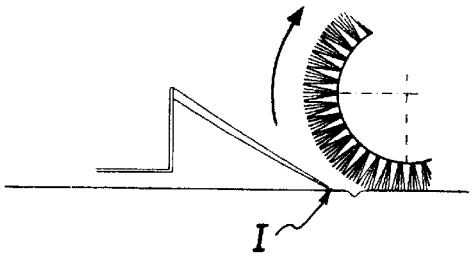
FIG. 5
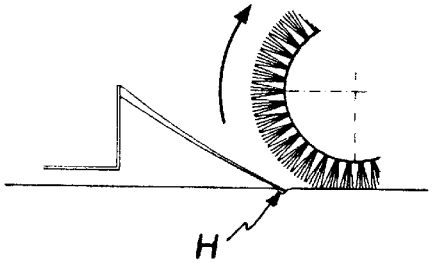
FIG. 6
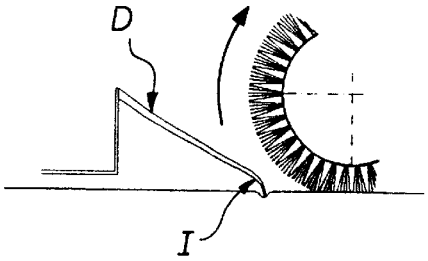
FIG. 7
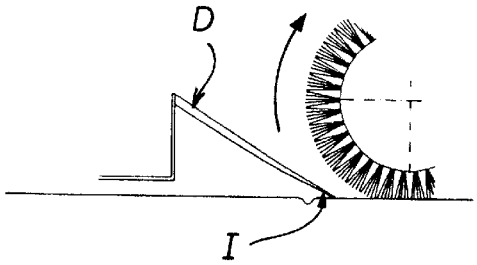
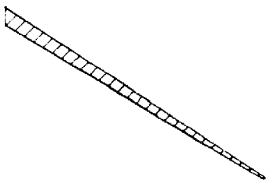
FIG. 8
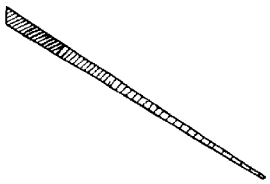
FIG. 9
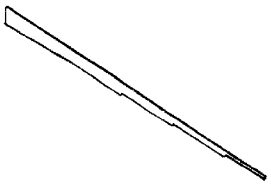
FIG. 10
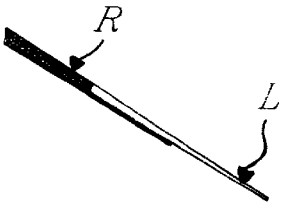
FIG. 11

VARIABLE ELASTICITY COLLECTION PAN FOR FLOOR CLEANING MACHINES

BACKGROUND OF THE INVENTION

1. Field of the Invention

The present invention concerns floor cleaning machines and especially such machines having pans for collecting debris.

2. History of the Related Art

At present, several kinds of machines are used for the removal of dirt and for washing and drying floors, which are provided either with a roller brush rotating on a horizontal axis, or with rotary brushes which rotate about a vertical axis.

In the known machines provided with a roller brush, the brush rotates against the floor, in the direction of motion of the machine. In the known machines provided with circular brushes, which rotate on an almost vertical or slightly inclined axis, during the rotary movement the internal part of the brushes advance in the direction of motion of the machine, so that dirt passes first in front and then to the side of the machine. The machines provided with roller brushes have some drawbacks in that it is not possible to clean and wash the floor in correspondence with the baseboard and with furniture, since the supports of the rollers hold them at a certain distance from the edge of the machine. On the other hand, the machines with horizontal rotary brushes ensure more uniform cleaning, since almost all the bristles of the brushes pass over the same space on the floor. Since the rotation of brushes exceeds the advance speed of the floor cleaning machine, during the normal advance of the machine the same portion of floor is brushed more than once.

It is desirable to design a machine suitable for cleaning any kind of floor and capable of operating in both directions.

To be able to work without problems when cleaning tiled floors or, however, floors with grooves or cracks, machines can be provided only with a front sliding pan, inclined in stable position, so that if they engage an obstacle they will not get stuck, or otherwise, the lower edge of the collecting pan must always be raised to prevent it from getting stuck and hindering the advance of the floor cleaning machine. The pans used at present are rectangular and their leading edge, which on uneven floors, gets stuck on protuberances and cracks. If the pan edge gets stuck on a crack, the machine suddenly stops and the pans bends and often breaks.

SUMMARY OF THE INVENTION

To eliminate the above mentioned drawbacks, a new kind of floor cleaning machine has been studied and designed, which is provided with a pan to collect solid dirt and wash liquids on floors which are most difficult to clean.

The machine, hereinafter called "floor sweeping and cleaning machine", is generally provided with a reservoir for the cleansing liquid, a device for spraying and drying the liquid, and with one or more rotary brushes positioned side by side and/or with a roller brush and with a front or rear compartment or pan for collecting dirt.

The rotation of the brushes removes solid dirt from the floor and conveys it first in front of the machine and then in the space between the two brushes. This movement pushes solid dirt into the collecting compartment.

Owing to the new kind of pan, the invention described herein makes it possible to clean any kind of floor and to avoid all the above mentioned drawbacks, since the pan slides on the floor and conveys all the dirt towards the compartment.

To collect dirt, a flexible pan is positioned behind the roller brush or rotary brushes; the pan slides on the floor and conveys the dirt removed by the brushes or by the roller brush into the collecting compartment.

The invention described herein makes it possible to clean both smooth and uneven floors, owing to the presence of the pan which, by adhering to the floor, collects all the dirt removed by the brushes and conveys it to the collecting compartment. When the pan gets stuck on the irregular surface of the floor, it releases itself and starts functioning again immediately.

The pan is made with such a shape and/or material that its lower edge always adheres to the floor so that when it meets irregularities, protuberances or cracks and the edge of the pan is blocked by the obstacle, it bends becauses of its elastic properties and then goes beyond the obstacle and adheres to the floor again. This new "floor sweeping and cleaning machine" provided with the new pan makes it possible to remove dirt completely from any kind of floor.

To serve the purpose effectively, the pan can be made of various shapes and materials.

In any case, the pan is capable of releasing itself from an obstacle because of its flexibility.

The new pan functions according to the following principles:

the pan bends in the presence of an obstacle;

bending is only upwards, since under the pan is the floor and the obstacle is in front of it.

In order to facilitate the bending of the pan, its elasticity in the portion between the leading edge and the edge in contact with the machine can vary, in particular, elasticity increases towards the leading edge.

Such gradual elasticity can be obtained, for example, by means of:

different materials with different elastic characteristics;

a triangular shape;

a section with multiple thicknesses;

several superimposed layers of homogeneous and nonhomogeneous materials;

nonhomogeneous materials with decreasing stiffness from the leading edge towards the edge which joins the pan and the machine.

If the machine is provided with brushes which rotate about a vertical axis, the new pan is formed in a generally triangular shape, which follows the profiles of two brushes.

The long side of the pan is fixed to the machine, while the other two sides are arc-shaped and join in a slightly rounded end, with the end being positioned between the two rotary brushes.

When there are cracks on the floor, this new generally triangular pan does not get stuck like normal pans; in fact, owing to its pointed shape, it can bend and then straighten again.

Maintenance operations, replacements and work stoppages are thus eliminated.

BRIEF DESCRIPTION OF THE DRAWINGS

The following is just an example among many of the practical embodiments of the invention in question, illustrated in the attached drawings wherein:

FIGS. 3–7 are illustrational views such, in progression, the manner in which the pan of the invention flexes when an object is encountered; and FIGS. 8–11 are cross-sections taken through pans having varying structural characteristics.

DESCRIPTION OF THE PREFERRED EMBODIMENT

Figure 1:
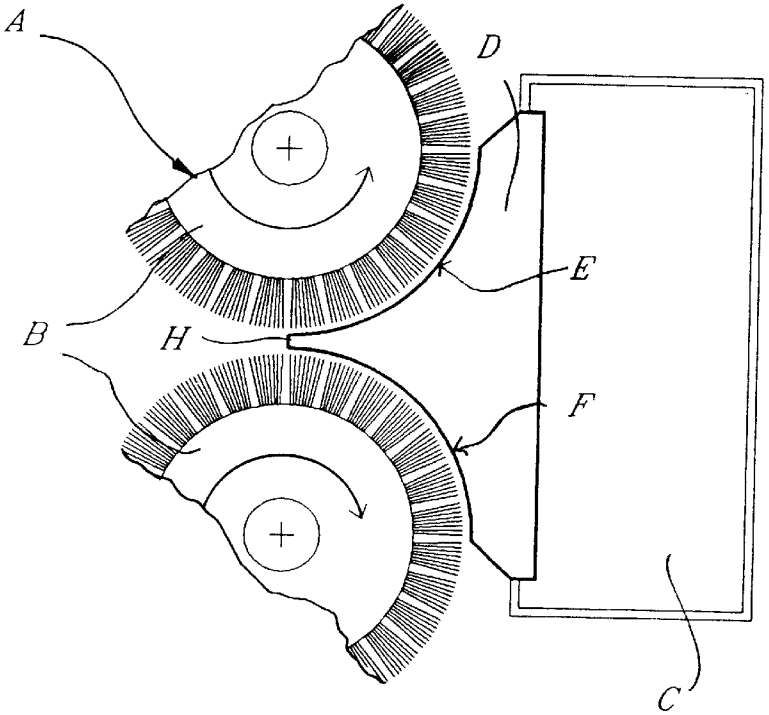
FIG. 1 is a partial top plan illustrational view of a floor cleaning machine using the pan of the present invention.

FIG. 1 is a schematic plan view of a floor cleaning machine A provided with two brushes B which rotate about a vertical axis, with a small basket or compartment C for collecting dirt and with a pan D which collects the dirt raised by the brushes B and conveys it into the collecting compartment.

The pan D has a generally triangular shape with the two sides E and F following the profile of the brushes B and being therefore curved; the two sides E and F join forming a point or leading edge H which is particularly elastic and can easily bend if it gets stuck in cracks, fissures, etc.

Figure 2A:
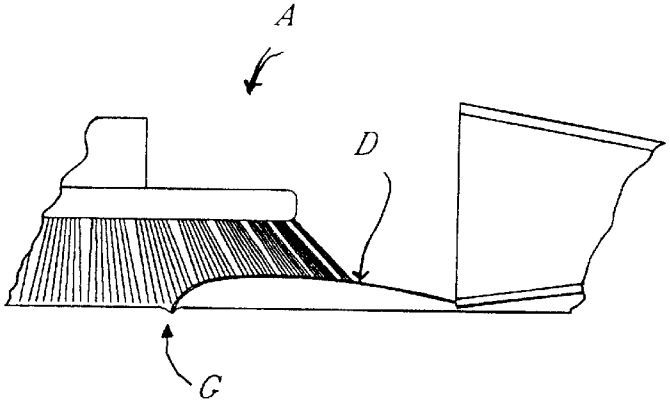
FIG. 2*a* is a partial side illustrational view of the pan of FIG. 1 with the tip of the pan in a crack.
Figure 2B:
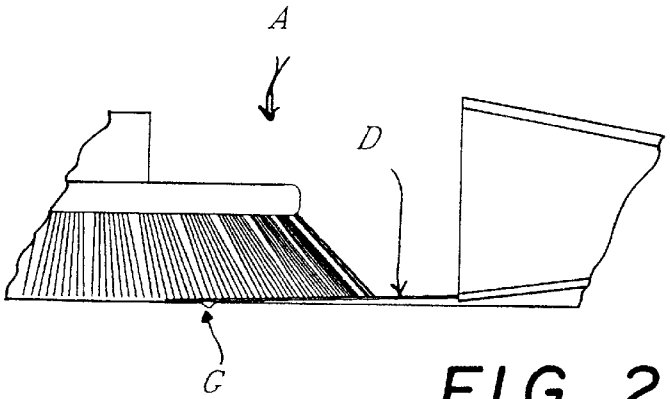
FIG. 2*b* is a partial side illustrational view of the pan as shown in FIG. 2*a* passing the crack.

FIG. 2*a* shows the pan D engaged in a crack G; the pan D bends but does not break, being particularly elastic; the machine A is pushed forwards and the pan D releases itself and returns to its original position, without breaking (FIG. 2*b*).

In this way the pan lasts longer and does not require maintenance, repair or work stoppages.

FIG. 3 shows a schematic section of the "floor sweeping and cleaning machine", in which it is possible to see a roller brush Bl which rotates about a horizontal axis, the sliding pan D for collecting dirt having a leading edge I and the compartment C.

FIGS. 4 to 7 show the operation of the new pan D when the leading edge I meets an obstacle G, which in this case is a crack. FIGS. 8 to 11 show several examples of structures of the pan with variable elasticity: using a triangular cross-section (FIG. 8); using material with different densities (FIG. 9); using sections with variable thicknesses (FIG. 10); and coupling of a substantially rigid material R with a substantially flexible end L (FIG. 11).

The above are the basic outlines of the invention, on the basis of which the technician will be able to provide for implementation; therefore, any change which may be necessary upon implementation is to be regarded as completely protected by the present invention.

With reference to the above description and the attached drawings, the following claims are put forth.

I claim:

1. In a pan for a machine for cleaning a floor wherein the machine includes a rotating brush for urging debris on the floor toward a collection receptacle, the improvement comprising:

a pan extending from an upper portion adjacent the collection receptacle downwardly and toward the brush to a leading edge which is adapted to slidingly engage the floor in an extended position, said pan being flexible and increasing in flexibility toward the leading edge so that said pan flexes upwardly when said leading edge engages an obstacle such that said leading edge thereof is freed to resume the extended position.

2. The pan of claim 1 wherein said pan varies in thickness, being thicker at said upper portion thereof than at said leading edge.

3. The pan of claim 1 wherein said pan decreases in density from said upper portion thereof to said leading edge.

4. The pan of claim 1 wherein said pan includes a plurality of superimposed material layers having different lengths between said upper portion thereof and said leading edge.

5. The pan of claim 1 wherein said upper portion of said pan is formed of a first material having a first flexibility and said leading edge thereof is formed of a second material having a greater flexibility.

6. The pan of claim 1 wherein said pan is generally triangular in shape, being wider adjacent said upper portion thereof.

7. The pan of claim 6 wherein said pan includes generally opposite inwardly curved edge portions extending from said upper portion to said leading edge thereof.

8. The pan of claim 7 wherein said leading edge is formed as a point.

* * * * *